US005214808A

United States Patent [19]

Schoonover et al.

[11] Patent Number: 5,214,808

[45] Date of Patent: Jun. 1, 1993

[54] APPARATUS AND METHOD FOR INCREASING VERTICAL MATTRESS ADJUSTMENT IN BABY CRIBS

[76] Inventors: Carleton M. Schoonover; Florence M. Schoonover, both of 1925 W. Lake Dr., Burlington, N.C. 27215

[21] Appl. No.: 962,648

[22] Filed: Oct. 19, 1992

[51] Int. Cl.[5] ..... A47D 7/02; A47D 7/03

[52] U.S. Cl. ..... 5/100; 5/93.1; 5/11

[58] Field of Search ..... 5/11, 93.1, 100, 427, 5/428

[56] References Cited

U.S. PATENT DOCUMENTS

| | | | |
|---|---|---|---|
| 754,140 | 3/1904 | Hollis | 5/100 |
| 2,011,909 | 8/1935 | Rice | 5/100 |
| 2,447,722 | 8/1948 | Webb | 5/11 |
| 2,630,582 | 3/1955 | Bukolt | 6/93.1 |
| 3,405,412 | 10/1968 | Mixon | 5/100 |
| 3,641,598 | 2/1972 | Feldstein | 5/100 |
| 3,649,973 | 3/1972 | Benoit et al. | 5/100 |
| 5,093,945 | 3/1992 | Schoonover et al. | 5/100 |
| 5,155,880 | 10/1992 | Schoonover et al. | 5/100 |

*Primary Examiner*—Michael F. Trettel

[57] ABSTRACT

The present invention provides a novel baby crib having means to mount a mattress platform at a variety of selected heights above the floor and a gate stop adjustable between an operative and an inoperative orientation. In the operative orientation, the gate stop prevents the gate from being lowered to its normally lowest position. In the inoperative orientation, the gate stop does not interfere with gate travel. The invention in a first embodiment provides means so that when the mattress is in the maximum height position, the gate stop must be in the operative orientation, thus preventing the gate from being lowered beyond the mattress height position.

3 Claims, 4 Drawing Sheets 53
53A
54
55
52
50
51
65
65

53
53A
54
55
52
50
51
65
65

HD
HF
53
53A
54
55
52
D
50
51
60
65
65

APPARATUS AND METHOD FOR INCREASING VERTICAL MATTRESS ADJUSTMENT IN BABY CRIBS

FIELD OF THE INVENTION

The invention disclosed relates to baby cribs and more particularly to the mattress support and gate positioning portions thereof.

BACKGROUND OF THE INVENTION

Currently known full-size baby cribs with dropside gates have vertical mattress adjustments of only 8 to 9 inches.

It is desirable to increase this mattress height adjustment because: 1) a mother with a new baby experiences less back strain when the top of the crib mattress is at a height of about 36 inches above the floor (standard working-counter height) to eliminate stooping when moving the infant in or out of the crib, and; 2) as the baby grows and begins to pull up to a standing position, the top of the mattress should be only 18 inches above the floor, which allows the mother to readily lift the infant when the infant is in a standing position. Also, when the infant is capable of standing in the crib it is important that the vertical distance from the top of the mattress to the top of the closed gate be sufficient to prevent the infant from climbing or falling out of the crib.

Instead of an adjustment of the mattress height of only 8 to 9 inches as is presently provided, the height adjustment should therefore be the difference between 36 inches and 18 inches, or about 18 inches. An approach to solving a part of this problem is taught in applicant's prior U.S. Pat. No. 5,155,880, the teachings of which are incorporated herein by reference.

Existing full size baby cribs with dropside gates have been almost identical in function and adjustability for many years. The available mattress positions, gate height and gate travel have thus been very restricted.

A "flush" mattress, i.e. one which is equal to or higher than the height of the lowered gate, is not allowed, according to the Code of Federal Regulations (CFR), because of the obvious danger. 16 CFR 1508.3(b)1 specifies a minimum of 9 inches vertical protection from the mattress platform to the top of the lowered gate when the platform is in its highest position. In addition 16 CFR 1508.3(b)2 specifies the protection from the lowest mattress platform position to the top of the raised gate to be 26 inches minimum.

Prior art cribs typically have gates which are about 28 inches high and have a vertical travel of only about 7 inches between two stopped gate positions—full up and full down. Existing cribs have a metal strip mounted on each of the four corner posts, which strips are capable of supporting the mattress platform at one of several vertical positions. The maximum distance between the highest and lowest mattress position is about 8½ inches in known cribs.

While the described prior art crib configuration meets the aforementioned Federal Regulations for crib safety, such configuration does not adequately satisfy the strained back problem of new mothers nor the safety of the infant.

SUMMARY OF THE INVENTION

The invention disclosed increases the vertical height through which the mattress is adjustable, increases gate travel and adds a third gate position which is between the conventional full up and full down positions. This intermediate position must be and is made operative when the mattress is in its highest position. When the gate is lowered and the mattress is in its top position, the gate makes contact with a stop device provided by the invention at a point where a minimum of 9 inches from the top of the gate rail to the top of the mattress support platform exists, thus complying with Federal Regulation 16 CFR 1508.3(b)1. The stop device of the invention allows a smaller portion of the gate travel from gate up to gate down positions when the mattress is in its highest position than that available when the mattress is in its middle or lowest position.

This added stop position in turn allows a taller crib gate with more travel than is possible in the prior art crib without changing the basic crib size. The advantage of this arangement is that the vertical mattress adjustment can be approximately doubled (from a present 8½ inches to 18 inches). With this increased adjustment the distance from the top of the gate to the top of the mattress platform in its lowest position is 32 inches, instead of 26, the minimum required by 16 CFR 1508.3(b)2.

BRIEF DESCRIPTION OF THE DRAWING

For ease of visualization.

FIG. 1 is a fragmented side elevation view of the crib apparatus of the invention showing the mattress in its highest position and the gate in the up position in solid lines and in the down position in dashed lines and showing a stop according to a first embodiment of the invention in its operative orientation.

FIG. 2 is a fragmented side elevation view of the FIG. 1 crib apparatus of the invention showing the mattress in its middle position and the gate in the up position in solid lines and in the down position in dashed lines and the inventive stop in its inoperative orientation.

FIG. 3 is a fragmented side elevation view of the FIG. 1 crib apparatus of the invention showing the mattress in its lowest position and the gate in the up position in solid lines and in the down position in dashed lines.

DESCRIPTION OF THE INVENTION

Figures 1, 2, 3:
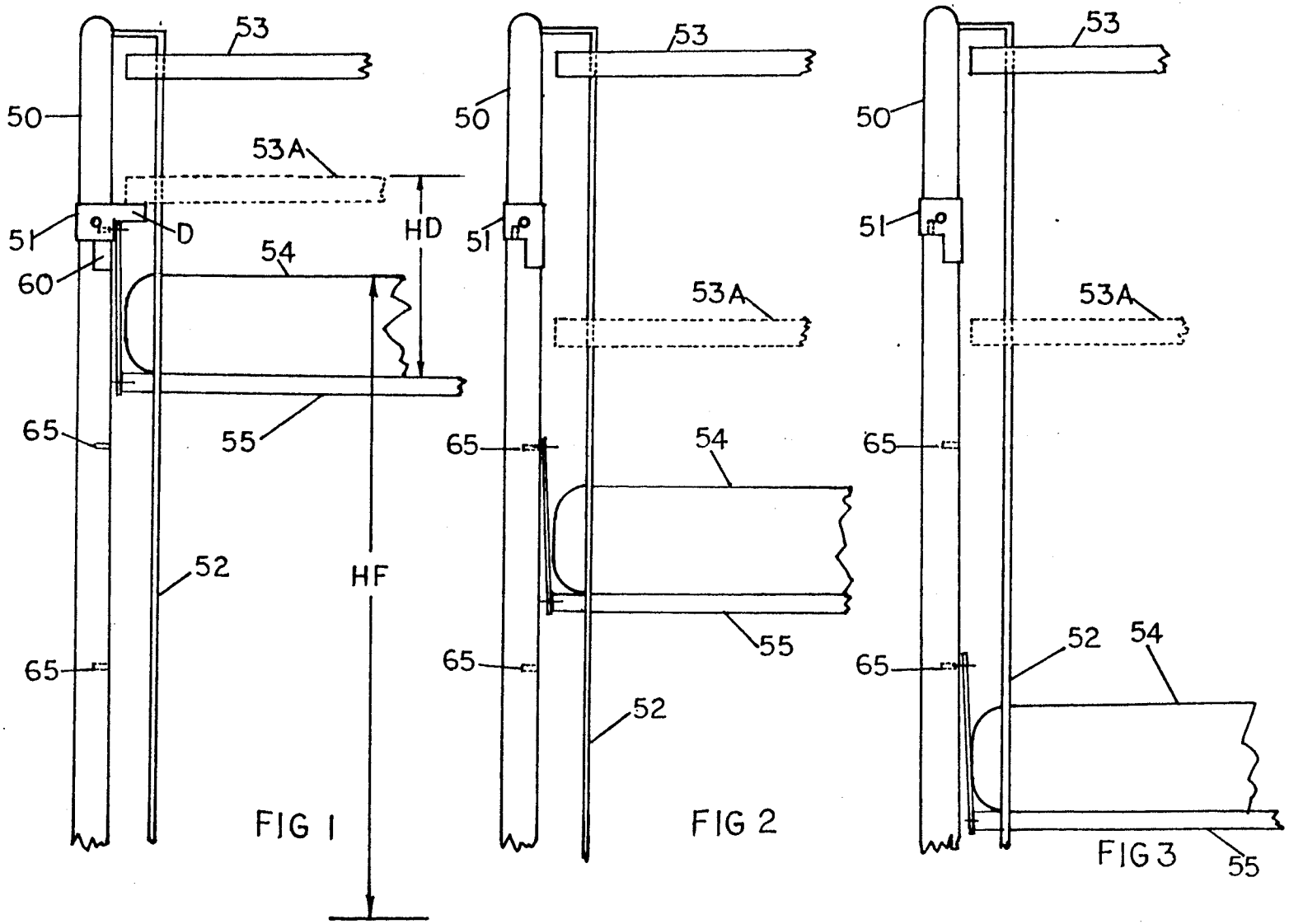
FIGS. 1, 2 and 3 are drawn on the same sheet at comparable heights to illustrate the relative positions of the gate and the mattress in each condition at one corner of the crib, it being understood that the illustrated construction would normally be duplicated at each corner of the crib.

A comparison of the views of the invention illustrated in FIGS. 1, 2, 3 shows the benefits obtained by practice of the invention. These three drawings depict the mattress in its high, medium and low positions, respectively, with commensurate positions of the gate shown in its up and down positions. All arrangements result in mattress platform to gate dimensions which comply with the requirements of 16 CFR 1508.3(b) as mentioned above. The particular advantage achieved by the addition of an added stopping position for gate 53 is that of permitting the height of the mattress 54 to be at a height above the floor of approximately 36 inches (shown in FIG. 1 as "HF") so that the mother of a newborn infant does not have to stoop when attending to the infant in the crib, while still keeping the lowered gate 53*a* above the height of the mattress 54 (FIG. 1). In addition, when the infant has grown such that the mattress 54 may be lowered, as shown in FIGS. 2 and 3, the gate 53 will be maintained at a height, in both the up and down positions, relative to the mattress 54 so as to better protect the infant from an accidental fall.

Further to the detail of FIG. 1, post 50 is typical of the posts of the crib which support the gate 53 and mattress 54 apparatus. As is known, gate 53 is held in a vertical plane by rods 52 in moving from its top to its bottom position. Some cribs are built with two operating gates, and so have four posts with gate stop apparatus; some cribs have only one operating gate and two posts with gate stop apparatus. In either design, the invention relates to the posts supporting an operating gate and contemplates a pair of cooperating intermediate stops 51 for selectively engaging opposite ends of each gate.

Figure 4:
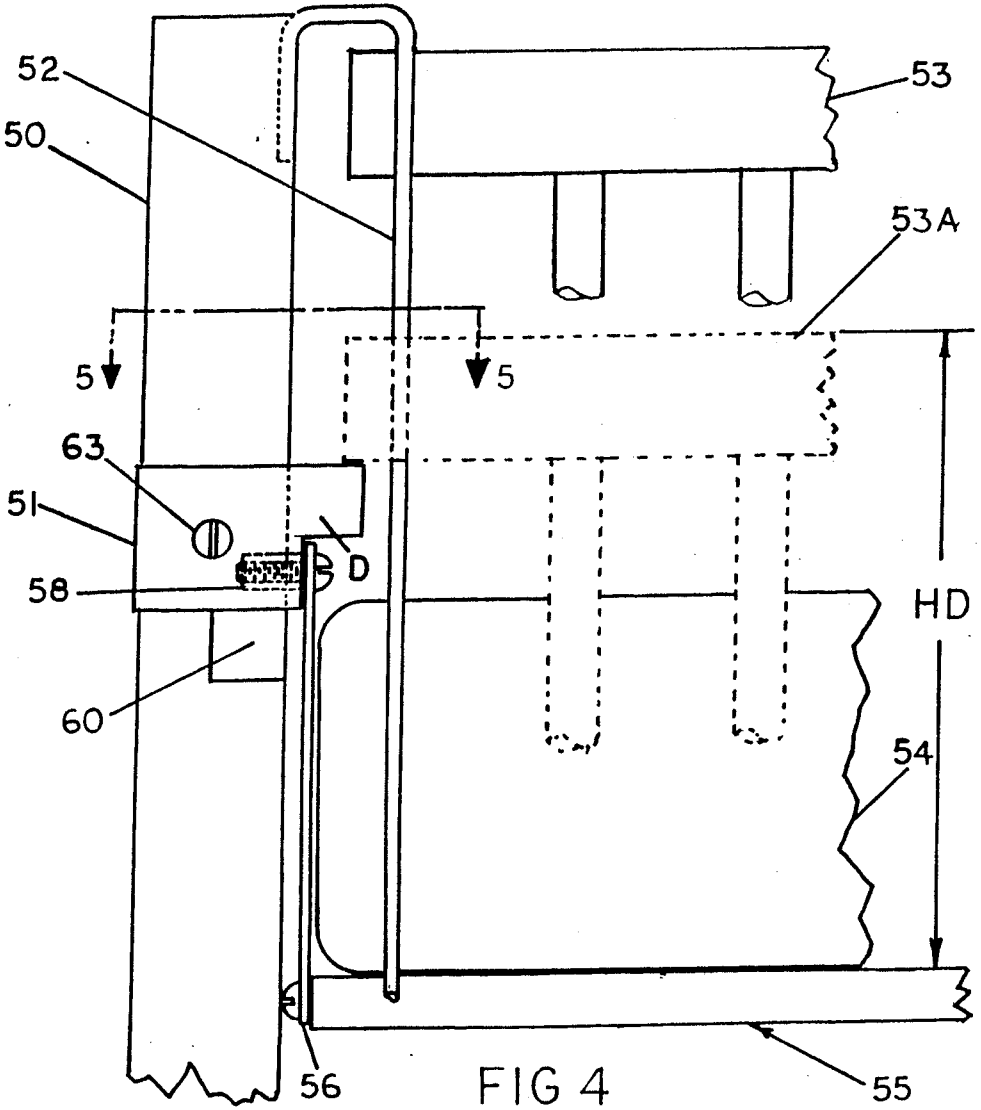
FIG. 4 is a fragmented side elevation view as FIG. 1 but in larger scale for greater detail.
Figure 9:
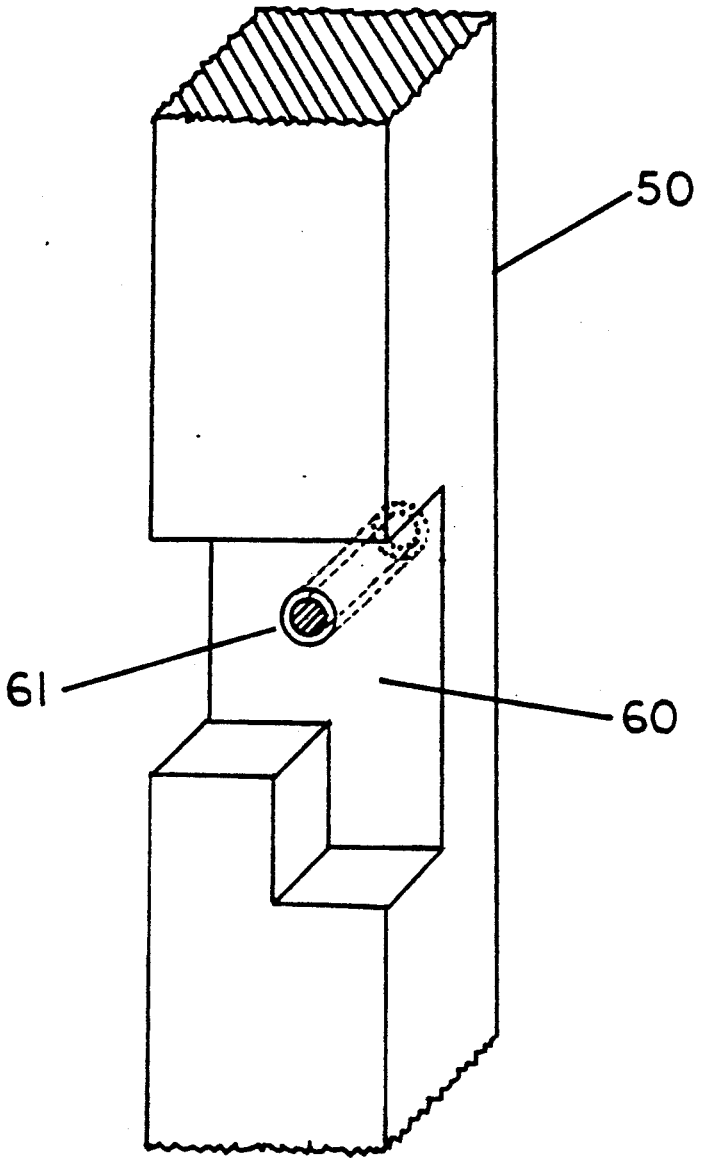
FIG. 9 is a fragmented perspective view of the crib post of the invention showing the detail of the cavity formed to accept the first embodiment stop therein.

A stop 51 is attached to each post 5C and partially nests into a cavity 60 (see FIG. 9) by means of a screw 63 threaded into post hole 61. As will be seen in FIGS. 1, 4, and 9, cavity 60 is configured to hold stop 51 in the operative orientation (as in FIGS. 1 and 4) or, when rotated, in the inoperative orientation (as in FIGS. 2, 3 and 6). When stop 51 is mounted in the operative orientation, sleeve 58 is horizontal and accessible for insertion of a screw to suspend mattress platform 55.

Figure 7:
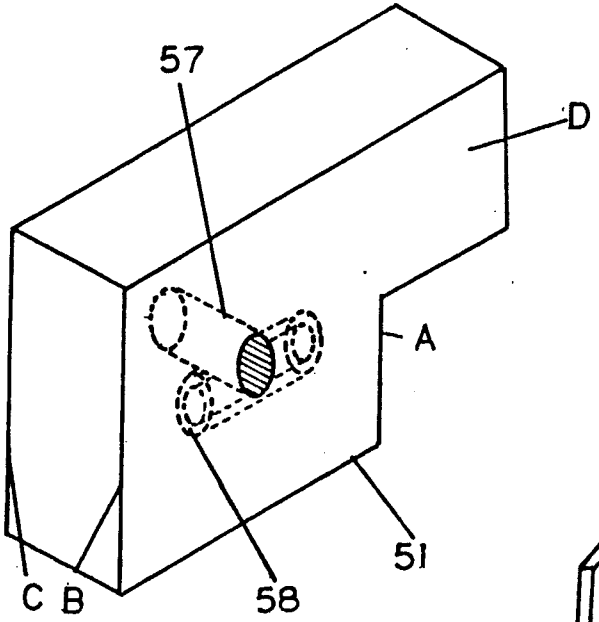
FIG. 7 is a perspective view of the first embodiment stop of the invention.

Stop 51 is seen in detailed perspective in FIG. 7 as being substantially an "L" shaped block. The internally threaded sleeve 58 is pressed with a snug fit into a hole formed through surface A of stop 51 and located beneath protrusion D. The internally threaded sleeve 58 may be formed of metal and utilized with stop 51 formed of wood or other firm material. Alternatively, stop 51 may be formed of a machinable plastic, such as polypropylene, in which case an internally threaded bore may be formed directly in stop 51. The axis of hole 57 is perpendicular to the axis of sleeve 58 and passes through stop 51 from surface B to surface C. On assembly, a screw is passed through hole 57 to anchor in hole 61 in post 50.

Figure 6:
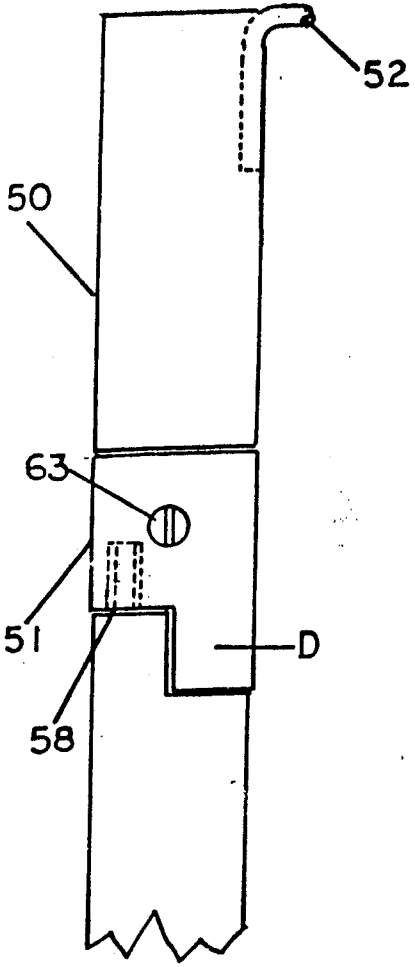
FIG. 6 is a fragmented side elevation view of a modified crib post mounting a stop according to the first embodiment of the invention and shown in a stored or inoperative position.

Referring now to partial assembly drawing FIG. 6, stop 51 is shown in its inoperative position attached to post 50 and nested in cavity 60. In this position, sleeve 58 is inaccessible and protrusion D is confined within the boundaries of post 50. Thus positioned, stop 51 is inoperative and will not prevent a gate 53 from dropping to a lower level when released.

Returning to FIGS. 1 and 4, it is seen that stop 51 is mounted in cavity 60 in the operative position with its protrusion D extending outwardly from post 51 in a position to intercept the downward travel of gate 53 at a height above that of the top of mattress 54. This is indicated by the dashed line gate position 53*a*. Strap 56, a lower end of which is adapted to suspend mattress platform 55, is mounted at an upper end by a screw threaded into sleeve 58 of stop 51. The invention recognizes that sleeve 58 of stop 51 provides the sole hanging means for hanging mattress platform 55 at its highest level. Accordingly, stop 51 in the FIG. 1 configuration is mounted in its operative orientation which allows mattress platform 55 to be hung at a height of 31 inches above the floor, according to the preferred embodiment. The invention also recognizes that in order to suspend mattress platform 55 at its highest position, stop 51 must be operative and the downward travel of gate 53 must terminate above the height of mattress 54.

Gate 53 is movable from a top position (solid lines) to an intermediate position 53*a* (dashed lines) in which its top rail is at least 9 inches higher than the mattress platform 55. This conforms to the requirement of 16 CFR 1508.3(b) but is low enough to allow the mother to easily handle the infant. This dimension is shown as "HD" in FIGS. 1 and 4.

Figure 5:
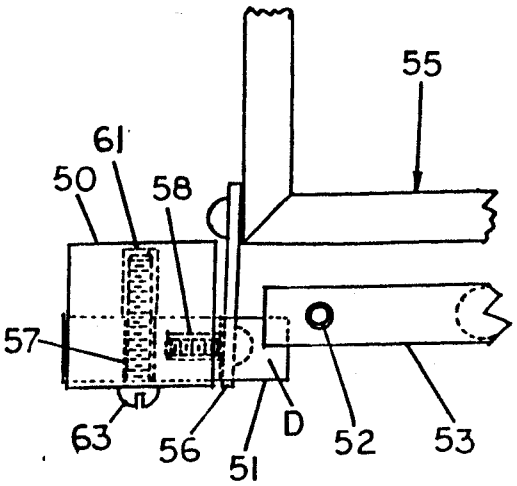
FIG. 5 is a partial top plan view taken in the direction of line 5—5 of FIG. 4.
Figure 8:
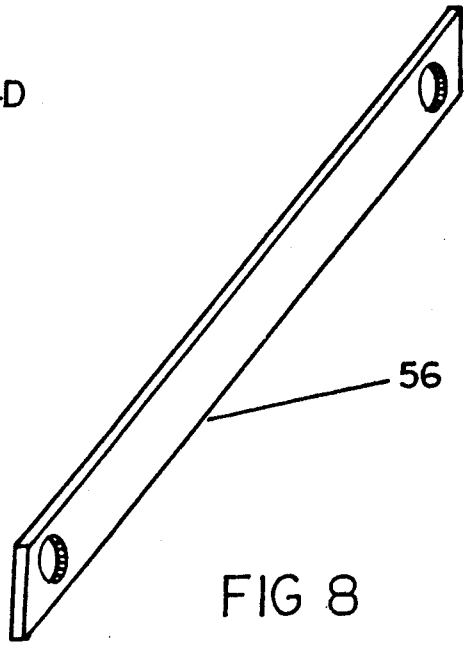
FIG. 8 is a perspective view of a strap used to suspend a mattress support platform according to the invention.

FIG. 5 illustrates a top view of a portion of the baby crib of the invention with mattress platform 55 in its highest position and strap 56 (FIG. 8) suspending the mattress platform 55 from stop 51. Stop 51 is partially nested in cavity 60 with protrusion D intercepting the downward travel of gate 53. An upper end of strap 56 is held by a screw threaded into sleeve 58 and a lower end of strap 56 is held by a screw threaded into the mattress platform 55.

As the infant grows, the mattress 54 is repositioned to a lower level, as shown in FIG. 2. At the intermediate level shown for the mattress platform 55, strap 56 is attached by means of a screw screwed into internally threaded sleeve 65 which is pressed into a hole in post 50 with a snug fit. At this mattress level as shown in FIG. 2, the invention recognizes that there is sufficient height differential to the position of lowered gate 53*a* stopped by the conventional gate stop such that there is no need for stop 51 of the invention. For this reason, and so that gate 53 can be lowered past stop 51, the invention construction permits stop 51 to be remounted on post 50 in its inoperative orientation as in FIG. 2. Stop 51 nests completely into cavity 60 (see FIG. 9) when in the inoperative orientation and is held by the same screw and hole as used in FIG. 1. In this inoperative orientation, sleeve 58 is nested within cavity 60 and inaccessible to a strap suspending screw. Therefore, the invention construction, for the infant's protection, prevents and makes impossible the mattress platform 55 being mounted in its highest position while allowing gate 53 to move lower and leave a "flush" mattress.

A similar condition exists in the situation of FIG. 3 in which the infant has grown more and is capable of standing in the crib. Mattress platform 55 is held by strap 56, the top end of which is mounted to post 50 by lowest threaded sleeve 65. Gate 53 is shown in its top position in solid lines and in its bottom position 53*a* in dashed lines. In FIG. 3 as in FIG. 2, stop 51 is nested in cavity 60, smoothly blending into the contour of post 50. At this relative position, the height from the top of mattress 54 to the top of raised gate 53 is approximately 26½ inches, and in its lowered position is approximately 16½ inches.

As described above, the invention fulfills its objections, conforms to applicable regulations and provide a useful improvement over pre-existing crib constructions. It is to be understood that variations on the basic concepts disclosed will be apparent to those skilled in the art and, as such, are considered within the scope and spirit of the invention.

We claim as our invention:

1. A baby crib, comprising:

(a) at least one pair of vertically oriented posts positioned substantially in a common vertical plane;

(b) a mattress platform extending from and supported in a horizontal plane perpendicular to said vertical plane of said posts;

(c) means for supporting said mattress platform at a selected elevation in relation to said posts;

(d) a gate residing between and substantially in said vertical plane of said posts and guided for vertical travel between a top and a bottom position by means attached to said posts; and (e) stop means mounted on at least one of said pair of posts and adjustable from an operative orientation in which said stop protrudes from said post engages and intercepts the downward travel of said gate at a position intermediate said top and bottom positions to an inoperative orientation in which said stop means is flush with the post and allows said gate to pass and reach said bottom position.

2. A baby crib as claimed in claim 1 further comprising mattress platform support means adapted to support said mattress platform at a selected one of a plurality of elevations where there is about 18 inches between the highest and lowest elevation.

3. A baby crib as claimed in claim 2 wherein said mattress platform support means is supported by said stop means when said mattress platform is its maximum elevation.

* * * * *